US009653806B2

(12) United States Patent
Ying

(10) Patent No.: US 9,653,806 B2
(45) Date of Patent: May 16, 2017

(54) MULTI-BAND WIRELESS TERMINALS WITH METAL BACKPLATES AND COUPLING FEED ELEMENTS, AND RELATED MULTI-BAND ANTENNA SYSTEMS

(75) Inventor: Zhinong Ying, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 483 days.

(21) Appl. No.: 14/127,908

(22) PCT Filed: Jul. 18, 2011

(86) PCT No.: PCT/IB2011/001661

§ 371 (c)(1),
(2), (4) Date: Dec. 19, 2013

(87) PCT Pub. No.: WO2013/011339

PCT Pub. Date: Jan. 24, 2013

(65) Prior Publication Data

US 2014/0132462 A1 May 15, 2014

(51) Int. Cl.

| | |
|---|---|
| ***H01Q 5/00*** | (2015.01) |
| ***H01Q 1/24*** | (2006.01) |
| ***H01Q 5/307*** | (2015.01) |

(52) U.S. Cl.

CPC ..... *H01Q 5/0027* (2013.01); *H01Q 1/243* (2013.01); *H01Q 5/307* (2015.01)

(58) Field of Classification Search

CPC ..... H01Q 5/307

See application file for complete search history.

(56) References Cited

U.S. PATENT DOCUMENTS

| | | | |
|---|---|---|---|
| 4,491,843 | A | 1/1985 | Boubouleix |
| 7,286,090 | B1 | 10/2007 | Rowell |
| 2002/0068601 | A1 | 6/2002 | Lindell |
| 2002/0180648 | A1 | 12/2002 | Boyle et al. |

FOREIGN PATENT DOCUMENTS

| | | | |
|---|---|---|---|
| CN | 1262791 | A | 8/2000 |
| CN | 1455971 | A | 11/2003 |
| WO | WO 99/03168 | | 1/1999 |
| WO | WO 2006087488 | A1 | 8/2006 |

OTHER PUBLICATIONS

Notification of Transmittal of the International Search Report and the Written Opinion of the International Searching Authority, or the Declaration, PCT/IB2011/001661, Feb. 28, 2012.

International Preliminary Report on Patentability, PCT/IB2011/001661, Jan. 21, 2014. (7 pages).

Chinese Office Action Corresponding to Chinese Patent Application No. 201180071579.5; Date Mailed: Jun. 4, 2015; Foreign Text, 5 Pages, English Translation Thereof, 6 Pages.

Chinese Office Action Corresponding to Chinese Patent Application No. 201180071579.5; Date Mailed: Sep. 23, 2014; Foreign Text, 7 Pages, English Translation Thereof, 8 Pages.

*Primary Examiner* — Hoang Nguyen
*Assistant Examiner* — Michael Bouizza
(74) *Attorney, Agent, or Firm* — Myers Bigel, P.A.

(57) ABSTRACT

An antenna system for use in a portable electronic device may include first and second metal elements. One of the first and second metal elements may be provided by a metal backplate of a housing of the portable electronic device. The antenna system may additionally include a coupling feed element between the first and second metal elements of the portable electronic device.

20 Claims, 12 Drawing Sheets

MULTI-BAND WIRELESS TERMINALS WITH METAL BACKPLATES AND COUPLING FEED ELEMENTS, AND RELATED MULTI-BAND ANTENNA SYSTEMS

RELATED APPLICATIONS

The present application is a 35 U.S.C. §371 national phase application of PCT International Application No. PCT/IB2011/001661, having an international filing date of Jul. 18, 2011, the disclosure of which is incorporated herein by reference in its entirety.

FIELD

The present inventive concept generally relates to the field of communications and, more particularly, to antennas and wireless terminals incorporating the same.

BACKGROUND

Conventional dipole antennas include two metal elements and a feeding line that matches the impedance of the two metal elements. For example, FIG. 1 illustrates a conventional dipole antenna 100 that includes first and second metal elements 102, 104, and a feeding line 103 between the first and second metal elements 102, 104. "Rabbit ears" antennas for televisions are one example of dipole antennas.

Wireless terminals may include impedance-matching circuitry. Additionally, wireless terminals may operate in multiple frequency bands to provide operations in multiple communications systems. For example, many cellular radiotelephones are designed for operation in Global System for Mobile Communications (GSM) and Wideband Code Division Multiple Access (WCDMA) modes at nominal frequencies of 850 Megahertz (MHz), 900 MHz, 1800 MHz, 1900 MHz, and/or 2100 MHz.

Achieving effective performance in multiple frequency bands (i.e., "multi-band") may be difficult. For example, contemporary wireless terminals are increasingly including more circuitry and larger displays and keypads/keyboards within small housings. Constraints on the available space and locations for antennas in wireless terminals can negatively affect antenna performance.

SUMMARY

Some embodiments of the present inventive concept include a multi-band wireless communications terminal. The multi-band wireless communications terminal may include a metal backplate covering a multi-band transceiver circuit configured to provide communications for the multi-band wireless communications terminal via a plurality of frequency bands, the metal backplate defining a slot between spaced-apart regions of the metal backplate. The multi-band wireless communications terminal may also include a grounding element bridging the slot between the spaced-apart regions of the metal backplate, the grounding element including a discrete circuit element. The multi-band wireless communications terminal may further include a coupling feed element bridging a portion of the slot between the spaced-apart regions of the metal backplate, the coupling feed element being spaced apart from and capacitively coupled to one of the spaced-apart regions of the metal backplate.

In some embodiments, the discrete circuit element may be at least partially recessed in the slot. Also, a first antenna including the grounding element may be configured to resonate in a first frequency band within the plurality of frequency bands in response to first electromagnetic radiation. Furthermore, the coupling feed element may be spaced apart from the grounding element, and may be at least partially recessed in the slot. Additionally, a second antenna including the coupling feed element may be configured to resonate in a second frequency band within the plurality of frequency bands in response to second electromagnetic radiation.

In some embodiments, the spaced-apart regions of the metal backplate may include a body portion of the metal backplate and an end portion of metal backplate adjacent the body portion of metal backplate, respectively. Also, the slot may separate the body portion of the metal backplate from the end portion of the metal backplate. Additionally, the coupling feed element may be spaced apart from and capacitively coupled to the end portion of the metal backplate.

In some embodiments, a dielectric material may cover the grounding element and the coupling feed element between the body portion of the metal backplate and the end portion of the metal backplate in the slot.

In some embodiments, the dielectric material may be substantially transparent.

In some embodiments, the body portion of the metal backplate and the end portion of the metal backplate may be connected to the same grounding point.

In some embodiments, the first frequency band may include lower frequencies than the second frequency band. Also, the second frequency band may include a wider band of frequencies than the first frequency band.

In some embodiments, the first frequency band may include cellular frequencies and the second frequency band may include non-cellular frequencies.

In some embodiments, the discrete circuit element of the grounding element may include one of an inductor and a meander line.

In some embodiments, first and second ends of the grounding element may be spaced apart by less than a length of the meander line, and a portion of the meander line may extend closer than the first and second ends of the grounding element to the coupling feed element.

In some embodiments, the metal backplate may be a unitary metal backplate.

In some embodiments, the coupling feed element may be less than about 1.0 millimeter from the end portion of the metal backplate.

In some embodiments, the second antenna may further include the spaced-apart regions of the metal backplate.

In some embodiments, a return loss corresponding to the coupling feed element in the second frequency band is between about −5.0 decibels (dB) and about −10.0 dB.

In some embodiments, the multi-band wireless communications terminal may further include a third antenna partially covered by the metal backplate, the third antenna being configured to resonate in a third frequency band in response to third electromagnetic radiation, and at least one of the second and third frequency bands including non-cellular frequencies. The metal backplate may include a notch spaced apart from the slot, and the third antenna may be at least partially recessed in the notch.

An antenna system for use in a portable electronic device according to some embodiments may include first and second metal elements. One of the first and second metal elements may be provided by a metal backplate of a housing of the portable electronic device. The antenna system may additionally include a coupling feed element between the first and second metal elements.

A multi-band antenna system according to some embodiments may include a metal backplate including a face, first and second sidewalls, and first and second ends, the metal backplate defining a slot in an edge of the face of the metal backplate adjacent the first end of the metal backplate. The antenna system may also include a grounding element including a discrete circuit element at least partially recessed in the slot, bridging the slot between the face of the metal backplate and the first end of the metal backplate, being partially covered by the face of the metal backplate. The antenna system may further include a first antenna including the grounding element being configured to resonate in a first frequency band in response to first electromagnetic radiation, the first frequency band including cellular frequencies. The antenna system may additionally include a coupling feed element bridging a portion of the slot between the face of the metal backplate and the first end of the metal backplate, being spaced apart from and capacitively coupled to the first end of the metal backplate, being spaced apart from the grounding element and at least partially recessed in the slot. The antenna system may also include a second antenna including coupling feed element being configured to resonate in a second frequency band in response to second electromagnetic radiation.

In some embodiments, the multi-band antenna system may further include a third antenna partially covered by the face of the metal backplate, the third antenna being configured to resonate in a third frequency band in response to third electromagnetic radiation, and at least one of the second and third frequency bands including non-cellular frequencies. Also, the metal backplate may include a notch in one of the first sidewall, the second sidewall, and the second end of the metal backplate. Moreover, the third antenna may be at least partially recessed in the notch.

In some embodiments, the face, first and second sidewalls, and second end of the metal backplate may define a unitary metal backplate.

In some embodiments, the unitary metal backplate may further include the first end of the metal backplate.

Other devices and/or systems according to embodiments of the inventive concept will be or become apparent to one with skill in the art upon review of the following drawings and detailed description. It is intended that all such additional devices and/or systems be included within this description, be within the scope of the present inventive concept, and be protected by the accompanying claims. Moreover, it is intended that all embodiments disclosed herein can be implemented separately or combined in any way and/or combination.

DETAILED DESCRIPTION OF EMBODIMENTS

Figure 1:
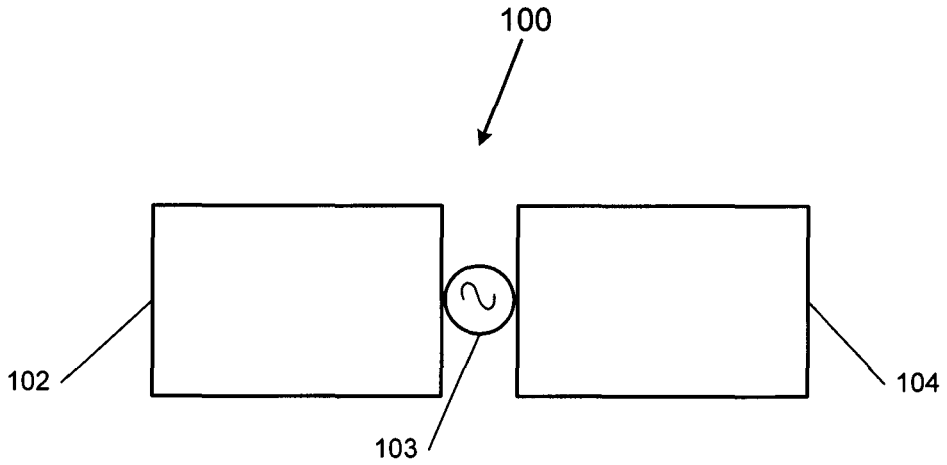
FIGURE 1 (PRIOR ART)
FIG. 1 illustrates a conventional dipole antenna.

The present inventive concept now will be described more fully with reference to the accompanying drawings, in which embodiments of the inventive concept are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concept are described herein in the context of multi-band wireless communication terminals ("wireless terminals"/"mobile terminals"/"terminals") that are configured to carry out cellular communications (e.g., cellular voice and/or data communications) in more than one frequency band. It will be understood, however, that the present inventive concept is not limited to such embodiments and may be embodied generally in any device and/or system that includes a multi-band Radio Frequency (RF) antenna that is configured to transmit and receive in two or more frequency bands.

Wireless terminals may not include sufficient space and locations for internally-housed antennas covering multiple bands and multiple systems. For example, some embodiments of the wireless terminals described herein may cover several frequency bands, including such frequency bands as 700-800 MHz, 824-894 MHz, 880-960 MHz, 1710-1880 MHz, 1820-1990 MHz, 1920-2170 MHz, 2300-2400 MHz, and 2500-2700 MHz. As such, as used herein, the term "multi-band" can include, for example, operations in any of the following bands: Advanced Mobile Phone Service (AMPS), ANSI-136, GSM, General Packet Radio Service (GPRS), enhanced data rates for GSM evolution (EDGE), Digital Communications Services (DCS), Personal Digital Cellular (PDC), Personal Communications Services (PCS), CDMA, wideband-CDMA, CDMA2000, and/or Universal Mobile Telecommunications System (UMTS) frequency bands. Other bands can also be used in embodiments according to the inventive concept. Also, some embodiments may be compatible with Long Term Evolution (LTE) and/or High Speed Packet Access (HSPA) standards. Some embodiments may include multiple antennas, such as a secondary antenna for Multiple Input Multiple Output (MIMO) and diversity applications. Some embodiments may provide coverage for non-cellular frequency bands such as Global Positioning System (GPS) and Wireless Local Area Network (WLAN) frequency bands. Additionally, a metal backplate for wireless terminals may provide a design that is desirable to users. Accordingly, some embodiments described herein may include antennas that use a metal backplate of a housing of a wireless terminal (or other portable electronic device) as an antenna element.

Figure 2:
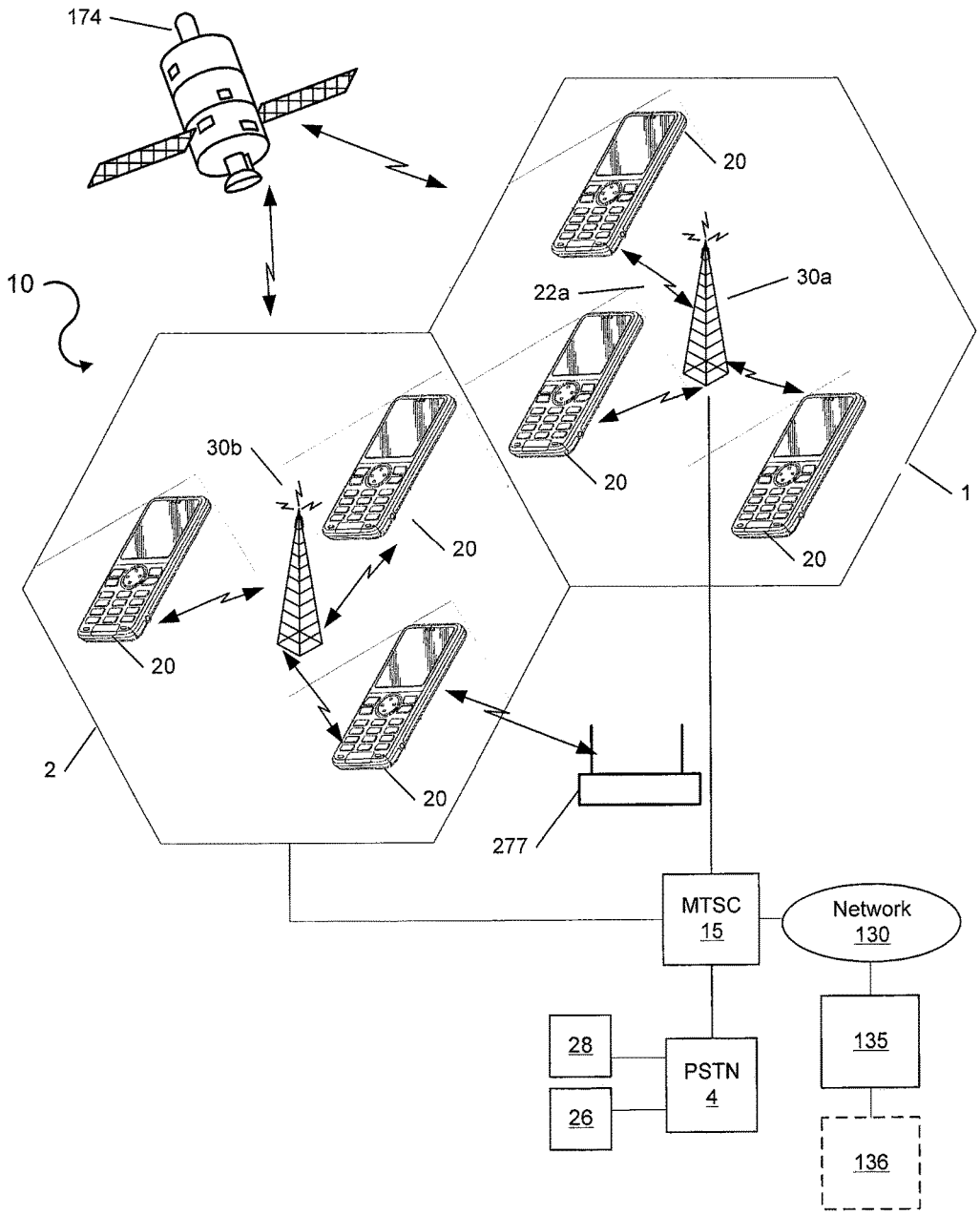
FIG. 2 is a schematic illustration of a wireless communications network that provides service to wireless terminals according to some embodiments of the present inventive concept.

Referring to FIG. 2, a diagram is provided of a wireless communications network 10 that supports communications in which wireless terminals 20 can be used according to some embodiments of the present inventive concept. The network 10 includes cells 1, 2 and base stations 30*a*, 30*b* in the respective cells 1, 2. Networks 10 are commonly employed to provide voice and data communications to subscribers using, for example, the standards discussed above. The network 10 may include wireless terminals 20 that may communicate with the base stations 30*a*, 30*b*. The wireless terminals 20 in the network 10 may also communicate with a Global Positioning System (GPS) 174, a local wireless network 277, a Mobile Telephone Switching Center (MTSC) 15, and/or a Public Service Telephone Network (PSTN) 4 (i.e., a "landline" network).

The wireless terminals 20 can communicate with each other via the Mobile Telephone Switching Center (MTSC) 15. The wireless terminals 20 can also communicate with other terminals, such as terminals 26, 28, via the Public Service Telephone Network (PSTN) 4, commonly referred to as a "landline" network, that is coupled to the network 10. As also shown in FIG. 2, the MTSC 15 is coupled to a computer server 135 supporting a location service 136 (i.e., a location server) via a network 130, such as the Internet.

The network 10 is organized as cells 1, 2 that collectively can provide service to a broader geographic region. In particular, each of the cells 1, 2 can provide service to associated sub-regions (e.g., the hexagonal areas illustrated by the cells 1, 2 in FIG. 2) included in the broader geographic region covered by the network 10. More or fewer cells can be included in the network 10, and the coverage area for the cells 1, 2 may overlap. The shape of the coverage area for each of the cells 1, 2 may be different from one cell to another and is not limited to the hexagonal shapes illustrated in FIG. 2. Each of the cells 1, 2 may include an associated base station 30*a*, 30*b*. The base stations 30*a*, 30*b* can provide wireless communications between each other and the wireless terminals 20 in the associated geographic region covered by the network 10.

Each of the base stations 30*a*, 30*b* can transmit/receive data to/from the wireless terminals 20 over an associated control channel. For example, the base station 30*a* in cell 1 can communicate with one of the wireless terminals 20 in cell 1 over the control channel 22*a*. The control channel 22*a* can be used, for example, to page the wireless terminal 20 in response to calls directed thereto or to transmit traffic channel assignments to the wireless terminal 20 over which a call associated therewith is to be conducted.

The wireless terminals 20 may also be capable of receiving messages from the network 10 over the respective control channel 22*a*. In some embodiments according to the inventive concept, the wireless terminals receive Short Message Service (SMS), Enhanced Message Service (EMS), Multimedia Message Service (MMS), and/or Smartmessaging™ formatted messages.

The GPS 174 can provide GPS information to the geographic region including cells 1, 2 so that the wireless terminals 20 may determine location information. The network 10 may also provide network location information as the basis for the location information applied by the wireless terminals. In addition, the location information may be provided directly to the server 135 rather than to the wireless terminals 20 and then to the server 135. Additionally or alternatively, the wireless terminals 20 may communicate with a local wireless network 277.

Figure 3:
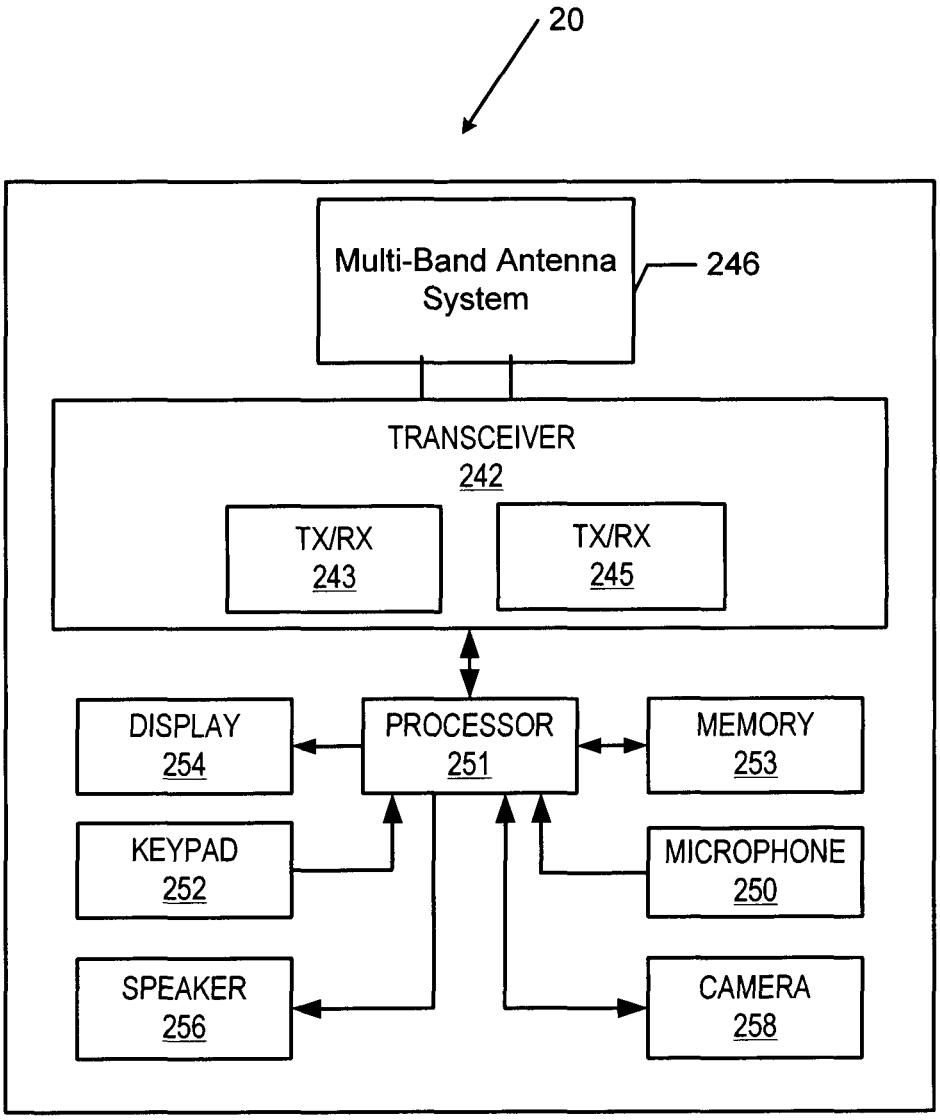
FIG. 3 is a block diagram illustrating multi-band wireless terminals according to some embodiments of the present inventive concept.

Referring now to FIG. 3, a block diagram is provided of a wireless terminal 20 that includes a multi-band antenna system 246 in accordance with some embodiments of the present inventive concept. As illustrated in FIG. 3, the wireless terminal 20 includes the multi-band antenna system 246, a transceiver 242, a processor 251, and can further include a display 254, keypad 252, speaker 256, memory 253, microphone 250, and/or camera 258.

The transceiver 242 may include transmit/receive circuitry (TX/RX) that provides separate communication paths for supplying/receiving RF signals to different radiating elements of the multi-band antenna system 246 via their respective RF feeds. Accordingly, when the multi-band antenna system 246 includes two antenna elements, the transceiver 242 may include two transmit/receive circuits 243, 245 connected to different ones of the antenna elements via the respective RF feeds.

A transmitter portion of the transceiver 242 converts information, which is to be transmitted by the wireless terminal 20, into electromagnetic signals suitable for radio communications. A receiver portion of the transceiver 242 demodulates electromagnetic signals, which are received by the wireless terminal 20 from the network 10 (illustrated in FIG. 2) to provide the information contained in the signals in a format understandable to a user of the wireless terminal 20.

It will be understood that the functions of the keypad 252 and the display 254 can be provided by a touch screen through which the user can view information, such as computer displayable documents, provide input thereto, and otherwise control the wireless terminal 20.

The transceiver 242 in operational cooperation with the processor 251 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the inventive concept. In some embodiments according to the inventive concept, the local wireless network 277 (illustrated in FIG. 2) is a WLAN compliant network. In some other embodiments according to the inventive concept, the local wireless network 277 is a Bluetooth compliant interface.

Referring still to FIG. 3, a memory 253 can store computer program instructions that, when executed by the processor circuit 251, carry out the operations described herein and shown in the figures. The memory 253 can be non-volatile memory, such as EEPROM (flash memory), that retains the stored data while power is removed from the memory 253.

Figure 4A:
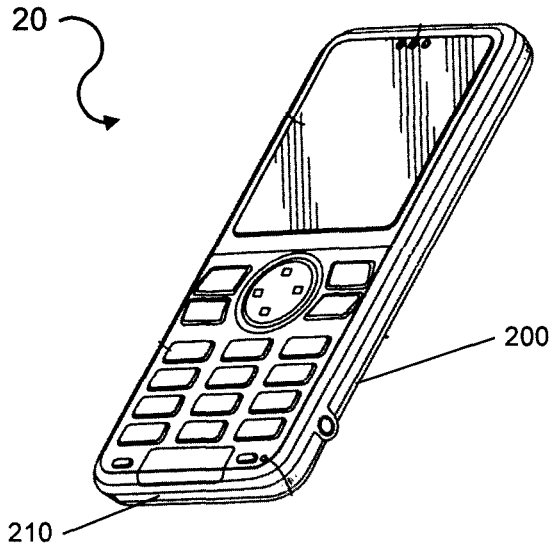
FIGS. 4A and 4B illustrate front and rear views, respectively, of a multi-band wireless terminal according to some embodiments of the present inventive concept.
Figure 4B:
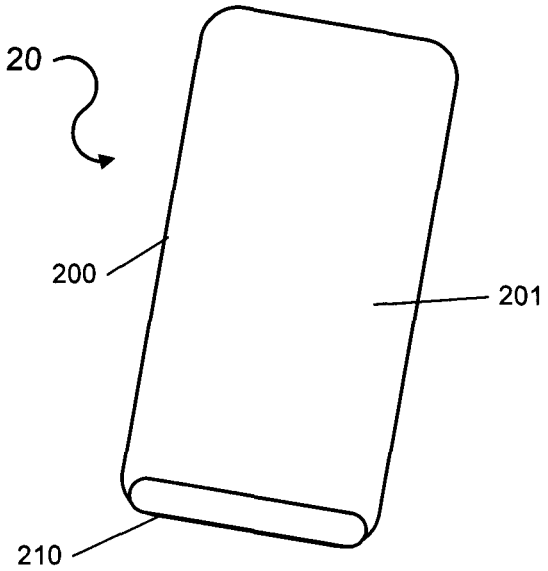

Referring now to FIGS. 4A and 4B, front and rear views, respectively, of the wireless terminal 20 are provided according to some embodiments of the present inventive concept. Accordingly, FIGS. 4A and 4B illustrate opposite sides of the wireless terminal 20. In particular, FIG. 4B illustrates an external face 201 of a metal backplate 200 (e.g., of a housing) of the wireless terminal 20. Accordingly, the external face 201 may be visible to, and/or in contact with, the user of the wireless terminal 20. In contrast, an internal face of the metal backplate 200 may face internal portions of the wireless terminal 20, such as the transceiver 242 (e.g., a multi-band transceiver circuit). Additionally, FIGS. 4A and 4B illustrate an end (e.g., bottom) portion 210 of the metal backplate 200.

Figure 5:
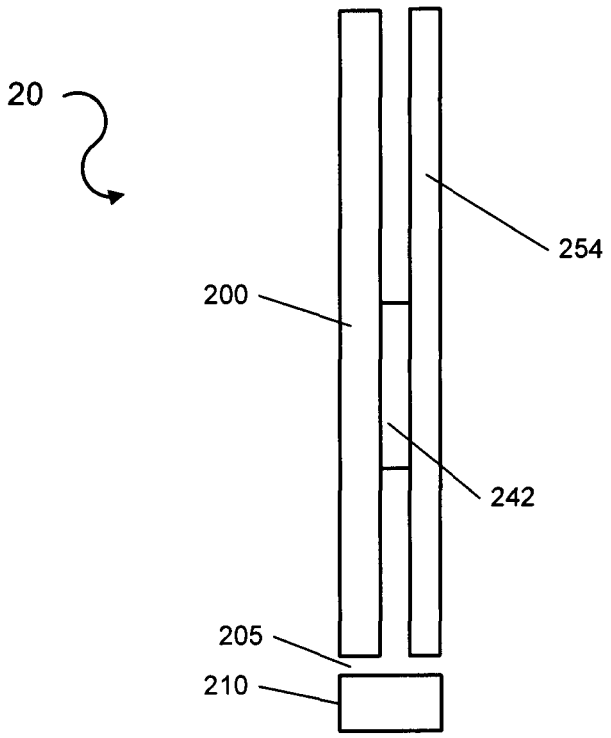
FIG. 5 illustrates a side view of a multi-band wireless terminal according to some embodiments of the present inventive concept.

Referring now to FIG. 5, a side view of the wireless terminal 20 is provided according to some embodiments of the present inventive concept. The transceiver 242 (e.g., a multi-band transceiver circuit) may be between the display 254 and the metal backplate 200. In some embodiments, the display 254 may be combined with the keypad 252 (illustrated in FIG. 3) as a touch screen.

A slot 205 (e.g., a gap) in the housing/metal backplate 200 may form spaced-apart regions (e.g., two spaced-apart regions) in the housing/metal backplate 200. The first spaced-apart region may be the body (e.g., main) portion of the housing/metal backplate 200. The second spaced-apart region may be the end portion 210 of the housing/metal backplate 200. Accordingly, the slot 205 may separate the end portion 210 of the housing/metal backplate 200 from the body portion of the housing/metal backplate 200. For example, a surface of the body portion of the housing/metal backplate 200 may be substantially parallel with a primary surface of the display 254. In contrast, a primary surface of the end portion 210 of the housing/metal backplate 200 may be substantially perpendicular to the primary surface of the display 254.

Figure 6:
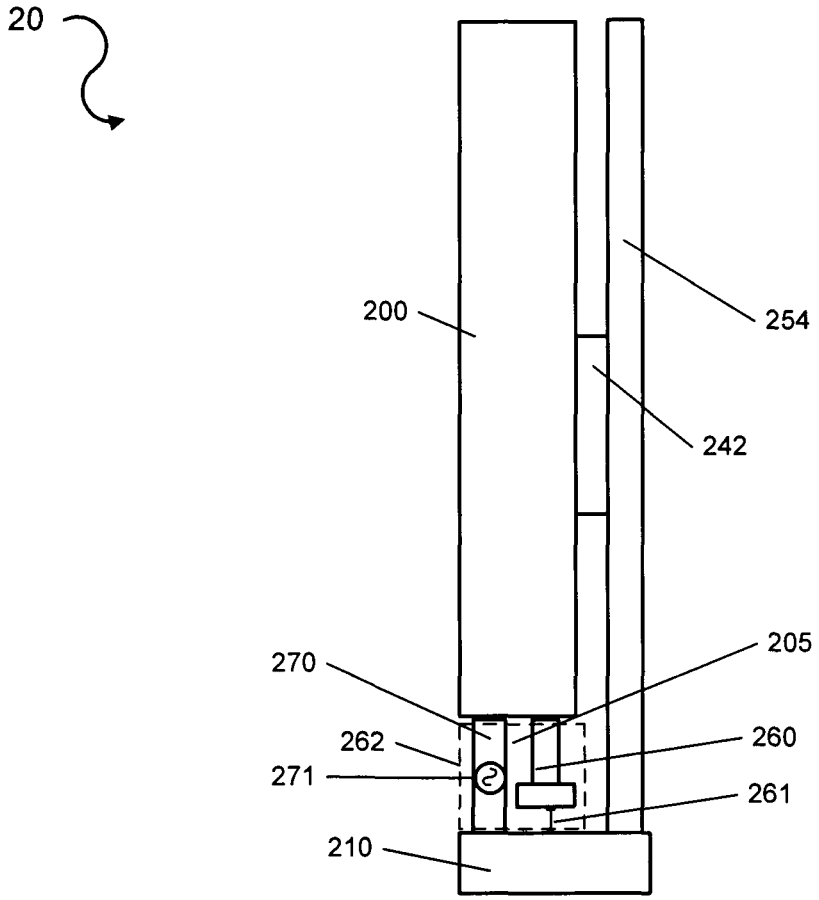
FIG. 6 illustrates a metal backplate including a coupling feed element and a grounding element according to some embodiments of the present inventive concept.

Referring now to FIG. 6, an illustration is provided of the metal backplate 200 including a coupling feed element 260 and a grounding element 270 according to some embodiments of the present inventive concept. The coupling feed element 260 may bridge a portion of the slot 205 between the two spaced-apart regions of the metal backplate 200. The coupling feed element 260 may be spaced apart from and capacitively coupled to one of the two spaced-apart regions of the metal backplate 200. For example, the coupling feed element 260 may be capacitively coupled to the end portion 210 of the metal backplate 200. Also, the coupling feed element 260 may be spaced apart from the end portion 210 of the metal backplate 200 by a distance 261. The distance 261 may be less than about 1.0 millimeter in some embodiments. Moreover, the coupling feed element 260 may be spaced apart from the grounding element 270 (e.g., by less than about 1.0 millimeter) and at least partially recessed in the slot 205.

The coupling feed element 260 may be one of various shapes. For example, referring still to FIG. 6, the coupling feed element 260 may have a T-shape in which the top of the T extends toward and is substantially parallel with a surface of the end portion 210 of the metal backplate 200. The top of the T of the coupling feed element 260 may be capacitively coupled to the substantially-parallel surface of the end portion 210 of the metal backplate 200. Alternatively, the coupling feed element 260 may have a meandering shape, a circular shape, or a rectangular shape, among other shapes. Additionally, the coupling feed element 260 may be substantially flat and/or may be a shape that is moldable into other shapes.

The grounding element 270 may bridge the slot 205 (e.g., bridge the entire length of the slot 205) between the two spaced-apart regions of the metal backplate 200. The grounding element 270 may include a discrete circuit element 271 at least partially recessed in the slot 205. In some embodiments, the body portion of the metal backplate 200 and the end portion 210 of the metal backplate 200 are connected to the same grounding point. For example, the end portion 210 of the metal backplate 200 may not physically contact the coupling feed element 260 but may be physically connected to the same grounding point as the body portion of the metal backplate 200. The grounding element 270 may have a greater surface area than the coupling feed element 260. In particular, the grounding element 270 may have a surface area that covers a substantial portion (e.g., at least 10%) of the internal face of the metal backplate 200.

Antennas of the wireless terminal 20 may include the grounding element 270 and the coupling feed element 260, respectively. For example, an antenna including the coupling feed element 260 may further include the body portion of the metal backplate 200 and the end portion 210 of the metal backplate 200. The coupling feed element 260 may match the impedance between the body portion of the metal backplate 200 and the end portion 210 of the metal backplate 200. Accordingly, some embodiments of the present inventive concept may include antennas that use the metal backplate 200 (e.g., of a housing) of the wireless terminal 20 (or other portable electronic device) as an antenna element.

An antenna including the coupling feed element 260 and an antenna including the grounding element 270 may each be configured to resonate in at least one of the frequency bands with which the transceiver 242 (e.g., a multi-band transceiver circuit) is operable. In some embodiments, the antenna including the coupling feed element 260 and the antenna including the grounding element 270 may each be configured to resonate in one of the frequency bands with which the transceiver 242 is operable in response electromagnetic radiation. In some embodiments, the antenna including the coupling feed element 260 is configured to resonate in one of the frequency bands with which the transceiver 242 is operable in response electromagnetic radiation, and the antenna including the grounding element 270 is configured to resonate in a different one of the frequency bands in response to different electromagnetic radiation. For example, the antenna including the grounding element 270 may be configured to resonate in a band of lower frequencies than the antenna including the coupling feed element 260. Additionally, the antenna including the coupling feed element 260 may be configured to resonate in a wider band of frequencies than the antenna including the grounding element 270. Moreover, the antenna including the coupling feed element 260 and the antenna including the grounding element 270 may be configured to resonate in non-overlapping frequency bands.

In some embodiments, the antenna including the grounding element 270 and/or the antenna including the coupling feed element 260 may be a multi-band antenna and/or may be configured to communicate cellular and/or non-cellular frequencies. For example, the antenna including the grounding element 270 may be configured to resonate in a frequency band that includes cellular frequencies and the antenna including the coupling feed element 260 may be configured to resonate in a frequency band that includes non-cellular frequencies. For example, the antenna including the coupling feed element 260 may be configured as an antenna for GPS, WLAN, or Bluetooth communications, among other non-cellular frequency communications.

A dielectric material 262 (illustrated using a broken line in FIG. 6) may be between the body portion of the metal backplate 200 and the end portion 210 of the metal backplate 200 in the slot 205. The dielectric material 262 may be a plastic or a glass material, among other suitable materials. In some embodiments, the dielectric material 262 may be substantially transparent. The dielectric material 262 may cover the grounding element 270 and the coupling feed element 260 between the body portion of the metal backplate 200 and the end portion 210 of the metal backplate 200 in the slot 205. According to some embodiments, the dielectric material 262 (e.g., an insulator) may, additionally or alternatively, be between the coupling feed element 260 and the grounding element 270. In some embodiments, the dielectric material 262 may cover the grounding element 270 and the coupling feed element 260, and a different dielectric material/insulator (not shown) may be between the grounding element 270 and the coupling feed element 260.

Figure 7A:
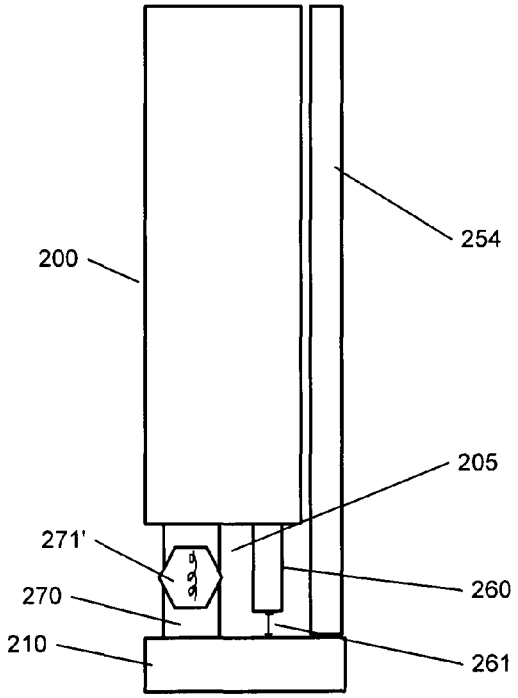
FIGS. 7A and 7B illustrate grounding elements that include an inductor and a meander line, respectively, according to some embodiments of the present inventive concept.
Figure 7B:
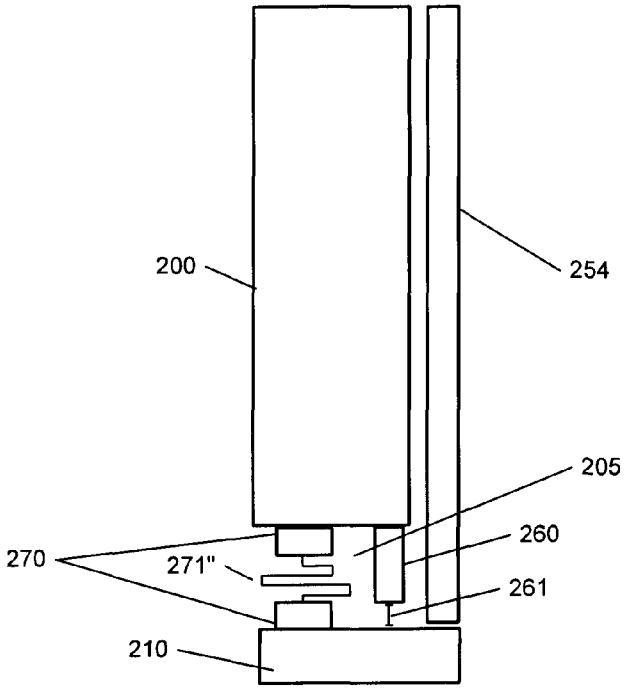

Referring now to FIGS. 7A and 7B, an illustration is provided of grounding elements 270 that include an inductor 271' and a meander line 271", respectively, according to some embodiments of the present inventive concept. In particular, FIG. 7A illustrates the grounding element 270 with a discrete circuit element 271 that is an inductor 271'. FIG. 7B, on the other hand, illustrates the grounding element 270 with a discrete circuit element 271 that is a meander line 271". For example, the meander line 271" meanders along a distance between two ends of the grounding element 270 such that the two ends of the grounding element 270 are spaced apart by less than the length (e.g., combined longitudinal and latitudinal lengths) of the meander line 271". A portion of the meander line 271" may extend closer to the coupling feed element 260 than the two ends of the grounding element 270 do. Additionally, the meander line 271" may extend a greater distance in a direction substantially perpendicular to a straight line between the two ends of the grounding element 270 than it extends in a direction substantially parallel to the straight line between the two ends of the grounding element 270.

Figure 8:
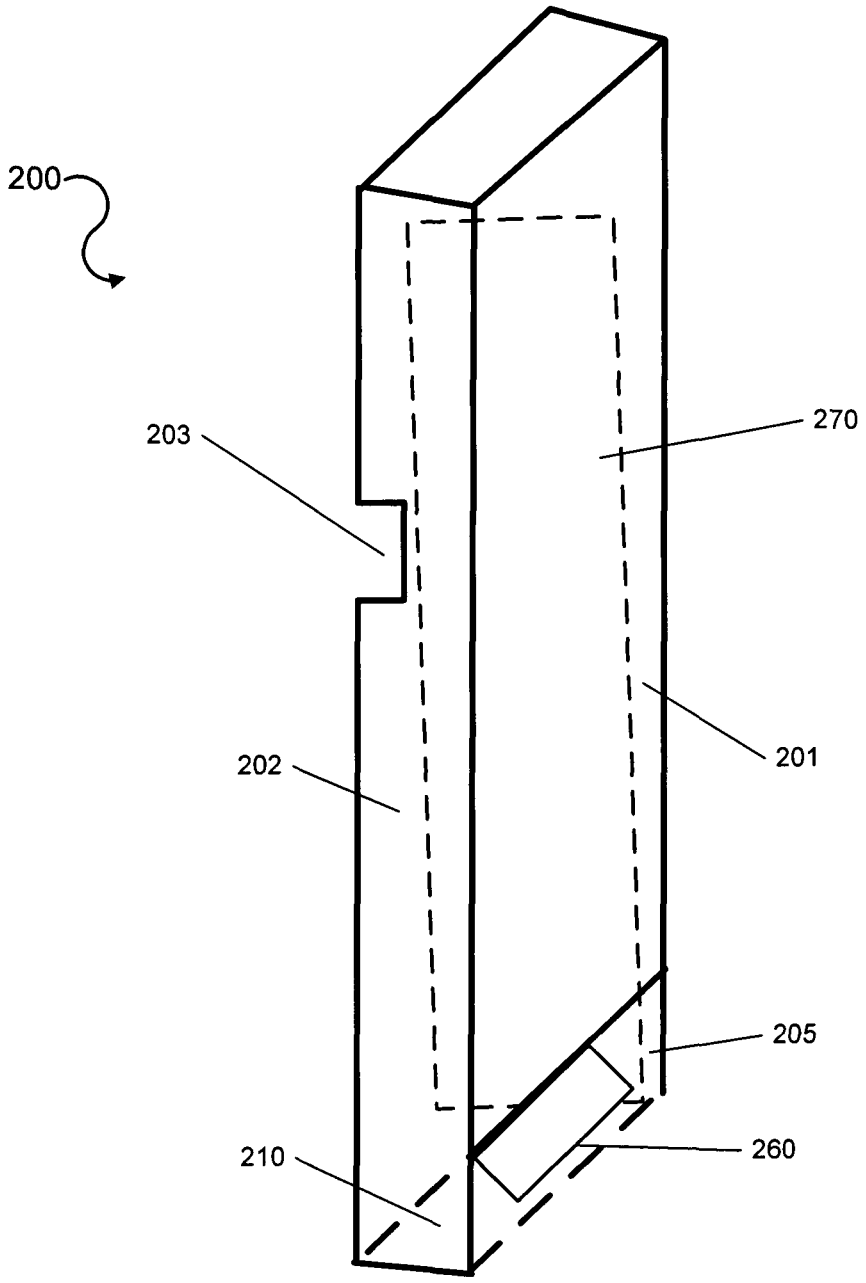
FIG. 8 illustrates a unitary metal backplate including a slot according to some embodiments of the present inventive concept.

Referring now to FIG. 8, an illustration is provided of a unitary metal backplate 200 including the slot 205 according to some embodiments of the present inventive concept. The unitary metal backplate 200 may be a contiguously-metal structure. For example, the unitary metal backplate 200 may be monolithic. In other words, at least the external face 201 of the unitary metal backplate 200 may be a unitary metal backplate that is formed from a single piece of metal. Additionally, the unitary metal backplate 200 may include a perimeter 202 around the external face 201. Accordingly, the slot 205 may be formed in the external face 201 of the unitary metal backplate 200 and may be adjacent the perimeter 202 of the unitary metal backplate 200. In some embodiments, the external face 201 of the metal backplate 200 may be fully and contiguously metal except for the slot 205.

The perimeter 202 of the unitary metal backplate 200 may contact the end portion 210 of the unitary metal backplate 200. Additionally, the external face 201 and the perimeter 202 may be a single piece of metal. Alternatively, the external face 201 and the perimeter 202 may be different pieces of metal that are attached to each other substantially without gaps therebetween. Accordingly, in some embodiments, the external face 201, the perimeter 202, and the end portion 210 of the unitary metal backplate 200 may be fully and contiguously metal except for the slot 205.

The perimeter 202 of the unitary metal backplate 200 may include a notch 203. The perimeter 202 may circle 360 degrees around the external face 201, and the notch 203 may be anywhere along the perimeter 202. Additionally, the notch 203 may be at a variety of depths within the perimeter 202. For example, in some embodiments, the notch 203 may be directly adjacent the external face 201. Alternatively, the notch 203 may be along an edge of the perimeter 202 farthest from the external face 201, or may be anywhere in between such an edge and the external face 201. Additionally, the notch 203 may be one of a variety of geometric shapes. For example, the notch 203 may be substantially circular, rectangular, or square, among other geometric shapes.

Figure 9:
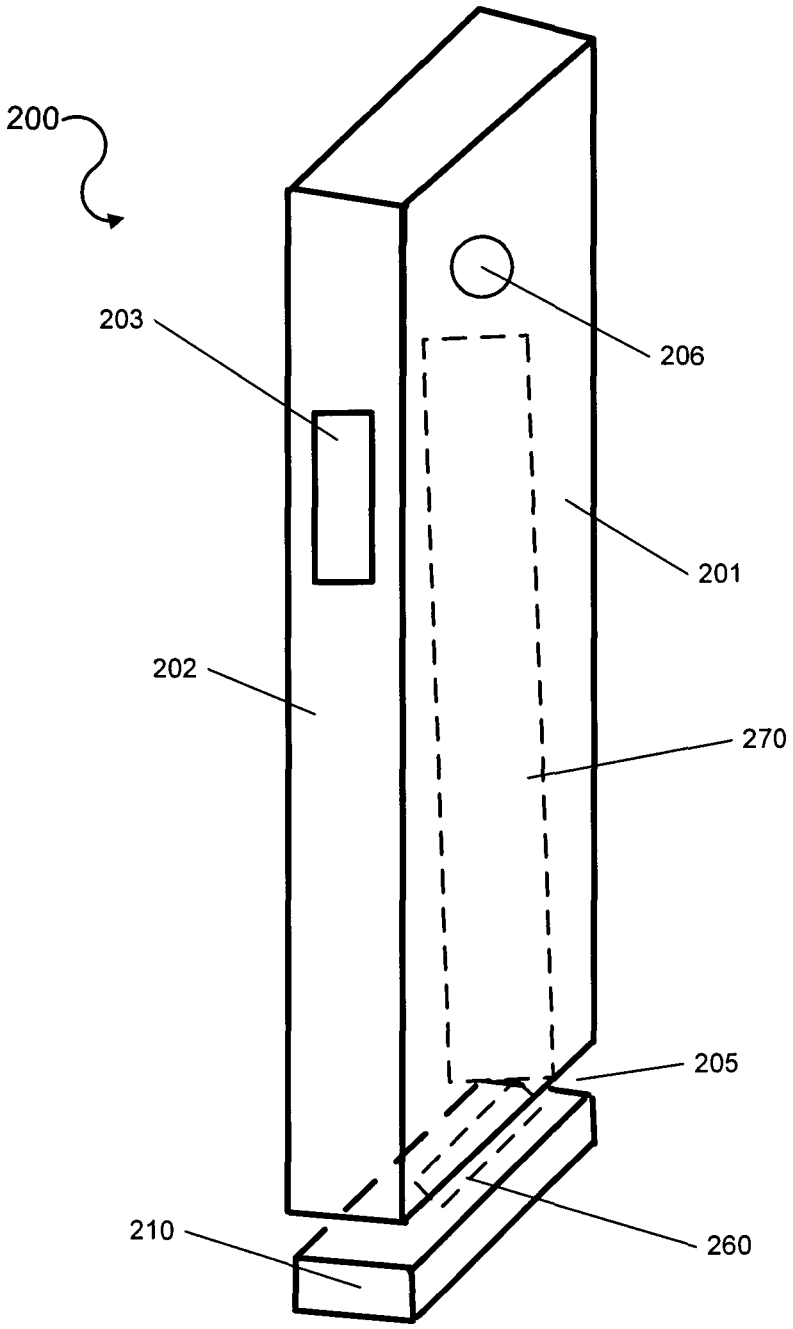
FIG. 9 illustrates a metal backplate including a void sized for optics of an imaging device according to some embodiments of the present inventive concept.

Referring now to FIG. 9, an illustration is provided of the metal backplate 200 including a void 206 in the external face 201 that is sized for optics of an imaging device (e.g., the camera 258 illustrated in FIG. 3) according to some embodiments of the present inventive concept. For example, the void 206 may be approximately the size of a lens and/or flash of the imaging device. Moreover, the void 206 may be configured to house the lens and/or flash of the imaging device. The imaging device may be one of a variety of cameras, including a still camera and/or a video camera. The external face 201 of the metal backplate 200 may be fully and contiguously metal except for the void 206 and/or the slot 205.

Still referring to FIG. 9, in some embodiments, the end portion 210 of the metal backplate 200 may be separated from the perimeter 202 of the metal backplate 200. For example, an insulator (e.g., the dielectric material 262 illustrated in FIG. 6) may separate the end portion 210 of the metal backplate 200 from the perimeter 202 of the metal backplate 200. Accordingly, the slot 205 may extend between the end portion 210 of the metal backplate 200 and the perimeter 202 of the metal backplate 200.

Figure 10:
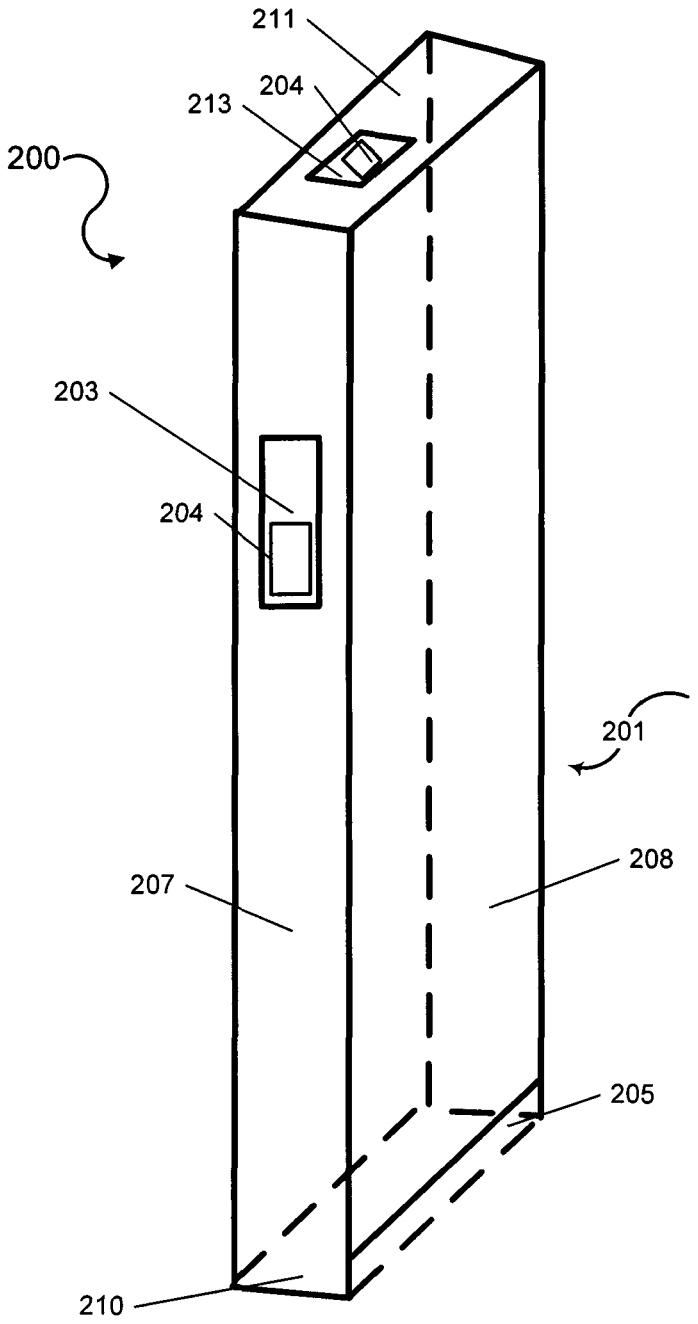
FIG. 10 illustrates a face, sidewalls, a top portion, and an end portion of a metal backplate according to some embodiments of the present inventive concept.

Referring now to FIG. 10, an illustration is provided of the external face 201, sidewalls 207, 208, top portion 211, and end portion 210 of the metal backplate 200 according to some embodiments of the present inventive concept. The external face 201, sidewalls 207, 208, top portion 211, and/or end portion 210 of the metal backplate 200 may define the metal backplate 200. One or more of the external face 201, the sidewalls 207, 208, and the top portion 211 may include a notch. For example, although the notch 203 is illustrated in the sidewall 207 and the notch 213 is illustrated in the top portion 211, notches could additionally or alternatively be included in the external face 201 and/or the sidewall 208.

An antenna 204 may be recessed in one or more of the notches 203, 213. The antennas 204 in the notches 203, 213 may be multi-band antennas. Additionally, the antennas 204 may be ones of various antennas configured for wireless communications. For example, each of the antennas 204 may be a monopole antenna or a planar inverted-F antenna (PIFA), among others. Additionally, each of the antennas 204 may be a multi-band antenna and/or may be configured to communicate cellular and/or non-cellular frequencies. Moreover, each of the antennas 204 may be a multi-band antenna included within the multi-band antenna system 246 illustrated in FIG. 3. Additionally, the antenna(s) 204 in one or more of the notches 203, 213 may be configured to resonate in the same or different frequency bands in which an antenna including the coupling feed element 260 and/or an antenna including the grounding element 270 may be configured to resonate.

In some embodiments, the metal backplate 200 may be a unitary metal backplate 200 that is solid metal. For example, with the exception of the slot 205, the notches 203, 213 and/or the void 206 (illustrated in FIG. 9), the unitary metal backplate 200 may be solid metal (e.g., free of hollow portions) from the external face 201 to the internal face of the unitary metal backplate 200.

Figure 11:
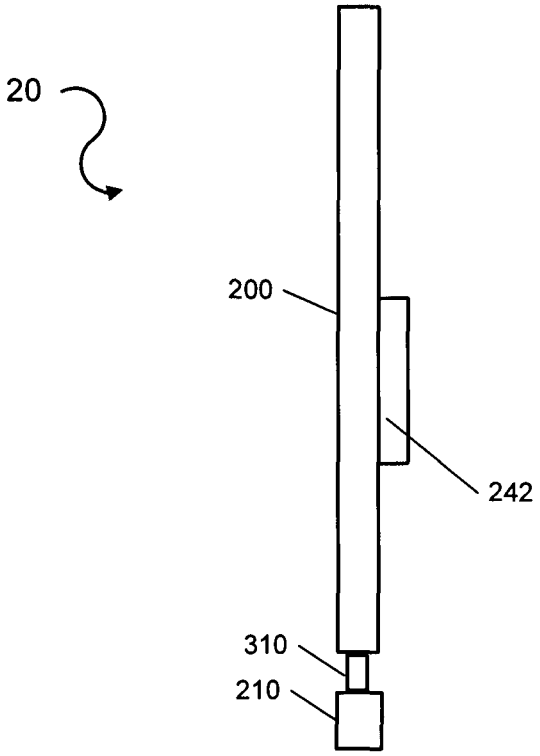
FIG. 11 illustrates a metal backplate including a discrete matching network according to some embodiments of the present inventive concept.

Referring now to FIG. 11, an illustration is provided of the metal backplate 200 including a discrete matching network 310 according to some embodiments of the present inventive concept. The end portion 210 of the metal backplate 200 may be matched as antenna using the discrete matching network 310. The discrete matching network 310 may be a totally discrete component.

Figure 12:
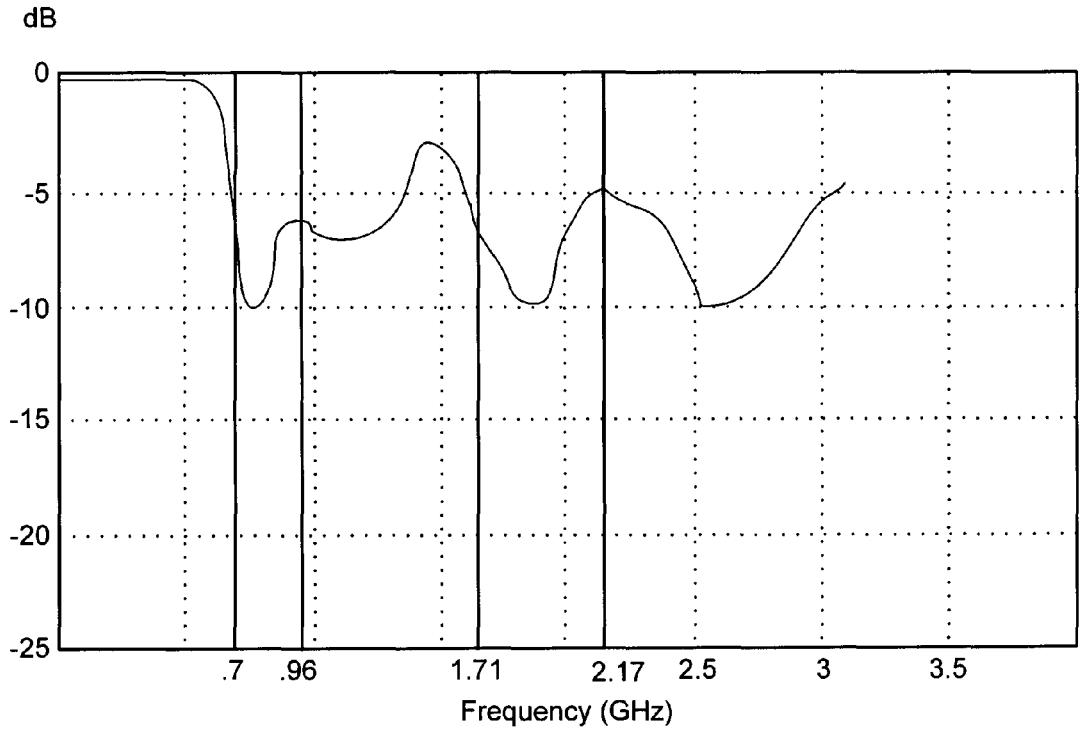
FIG. 12 illustrates antenna matching return loss results according to some embodiments of the present inventive concept.

Referring now to FIG. 12, an illustration is provided of antenna matching return loss results according to some embodiments of the present inventive concept. A return loss corresponding to antenna matching of the coupling feed element 260 and/or the grounding element 270 may be between about −5.0 decibels (dB) and about −10.0 dB. For example, the band of frequencies between about 1.71 Gigahertz (GHz) and about 2.17 GHz may be resonated by an antenna including the coupling feed element 260 with a return loss between about −5.0 dB and about −10.0 dB. Accordingly, the antenna including the coupling feed element 260 may provide a relatively wide frequency response. For example, a low Q factor may provide wide frequency matching. Moreover, the antenna including the coupling feed element 260 may provide a frequency response up to about 3.0 GHz. Additionally, a narrower band of frequencies between about 700 MHz and about 960 MHz may be resonated by an antenna including the grounding element 270 with a return loss between about −5.0 dB and about −10.0 dB. In some embodiments, the band of frequencies resonated by the antenna including the coupling feed element 260 may be a harmonic of the band of frequencies resonated by the antenna including the grounding element 270.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A multi-band wireless communications terminal comprising:

a metal backplate covering a multi-band transceiver circuit configured to provide communications for the multi-band wireless communications terminal via a plurality of frequency bands, the metal backplate defining a slot between spaced-apart regions of the metal backplate;

a grounding element bridging the slot between the spaced-apart regions of the metal backplate, the grounding element including a discrete circuit element; and a coupling feed element bridging a portion of the slot between the spaced-apart regions of the metal backplate, the coupling feed element being spaced apart from and capacitively coupled to one of the spaced-apart regions of the metal backplate.

2. The multi-band wireless communications terminal of claim 1, wherein the discrete circuit element is at least partially recessed in the slot;

wherein a first antenna including the grounding element is configured to resonate in a first frequency band within the plurality of frequency bands in response to first electromagnetic radiation;

wherein the coupling feed element is spaced apart from the grounding element, and is at least partially recessed in the slot; and wherein a second antenna including the coupling feed element is configured to resonate in a second frequency band within the plurality of frequency bands in response to second electromagnetic radiation.

3. The multi-band wireless communications terminal of claim 1, wherein the spaced-apart regions of the metal backplate comprise a body portion of the metal backplate and an end portion of metal backplate adjacent the body portion of metal backplate, respectively;

wherein the slot separates the body portion of the metal backplate from the end portion of the metal backplate; and wherein the coupling feed element is spaced apart from and capacitively coupled to the end portion of the metal backplate.

4. The multi-band wireless communications terminal of claim 3, wherein a dielectric material covers the grounding element and the coupling feed element between the body portion of the metal backplate and the end portion of the metal backplate in the slot.

5. The multi-band wireless communications terminal of claim 4, wherein the dielectric material is substantially transparent.

6. The multi-band wireless communications terminal of claim 3, wherein the body portion of the metal backplate and the end portion of the metal backplate are connected to the same grounding point.

7. The multi-band wireless communications terminal of claim 2, wherein the first frequency band includes lower frequencies than the second frequency band;

wherein the second frequency band includes a wider band of frequencies than the first frequency band; and wherein the first frequency band includes cellular frequencies and the second frequency band includes non-cellular frequencies.

8. The multi-band wireless communications terminal of claim 1, wherein the discrete circuit element of the grounding element comprises one of an inductor and a meander line.

9. The multi-band wireless communications terminal of claim 8, wherein first and second ends of the grounding element are spaced apart by less than a length of the meander line; and wherein a portion of the meander line extends closer than the first and second ends of the grounding element to the coupling feed element.

10. The multi-band wireless communications terminal of claim 1, wherein the metal backplate is a unitary metal backplate.

11. The multi-band wireless communications terminal of claim 3, wherein the coupling feed element is less than about 1.0 millimeter from the end portion of the metal backplate.

12. The multi-band wireless communications terminal of claim 2, wherein the second antenna further comprises the spaced-apart regions of the metal backplate.

13. The multi-band wireless communications terminal of claim 2, wherein a return loss corresponding to the coupling feed element in the second frequency band is between about −5.0 dB and about −10.0 dB.

14. The multi-band wireless communications terminal of claim 2, further comprising:

a third antenna partially covered by the metal backplate, the third antenna being configured to resonate in a third frequency band in response to third electromagnetic radiation, and at least one of the second and third frequency bands including non-cellular frequencies, wherein the metal backplate includes a notch spaced apart from the slot; and wherein the third antenna is at least partially recessed in the notch.

15. The multi-band wireless communications terminal of claim 1, wherein the coupling feed element bridges a majority of the slot.

16. An antenna system for use in a portable electronic device, the antenna system comprising:

first and second metal elements, wherein one of the first and second metal elements is provided by a metal backplate of a housing of the portable electronic device; and a capacitive-coupling feed element between the first and second metal elements, wherein the capacitive-coupling feed element physically contacts the first metal element and does not physically contact the second metal element.

17. The antenna system of claim 16, further comprising a grounding element that is between the first and second metal elements and that physically contacts each of the first and second metal elements.

18. A multi-band antenna system comprising:

a metal backplate comprising a face, first and second sidewalls, and first and second ends, the metal backplate defining a slot in an edge of the face of the metal backplate adjacent the first end of the metal backplate;

a grounding element including a discrete circuit element at least partially recessed in the slot, bridging the slot between the face of the metal backplate and the first end of the metal backplate, being partially covered by the face of the metal backplate;

a first antenna including the grounding element being configured to resonate in a first frequency band in response to first electromagnetic radiation, the first frequency band including cellular frequencies;

a coupling feed element bridging a portion of the slot between the face of the metal backplate and the first end of the metal backplate, being spaced apart from and capacitively coupled to the first end of the metal backplate, being spaced apart from the grounding element and at least partially recessed in the slot; and a second antenna including coupling feed element being configured to resonate in a second frequency band in response to second electromagnetic radiation.

19. The multi-band antenna system of claim 18, further comprising:

A third antenna partially covered by the face of the metal backplate, the third antenna being configured to resonate in a third frequency band in response to third electromagnetic radiation, and at least one of the second and third frequency bands including non-cellular frequencies, wherein the metal backplate includes a notch in one of the first sidewall, the second sidewall, and the second end of the metal backplate; and wherein the third antenna is at least partially recessed in the notch.

20. The multi-band antenna system of claim 18, wherein the face, first and second sidewalls, and second end of the metal backplate define a unitary metal backplate, and wherein the unitary metal backplate further comprises the first end of the metal backplate.

* * * * *